US006408554B1

(12) United States Patent
Przylucki

(10) Patent No.: US 6,408,554 B1
(45) Date of Patent: Jun. 25, 2002

(54) FOUR PANEL VISUAL DISPLAY SYSTEM

(76) Inventor: Thomas S. Przylucki, 6714 Walton Heath, Houston, TX (US) 77069

( * ) Notice: Subject to any disclaimer, the term of this patent is extended or adjusted under 35 U.S.C. 154(b) by 0 days.

(21) Appl. No.: 09/617,344

(22) Filed: Jul. 17, 2000

(51) Int. Cl.[7] ..... G09F 3/18

(52) U.S. Cl. ..... 40/661.08; 40/611; 40/735; 40/765; 248/174

(58) Field of Search ..... 40/661.08, 606, 40/661, 750, 1, 672, 453, 539, 611, 729, 735, 765, 791; 248/444.1, 459, 174

(56) References Cited

U.S. PATENT DOCUMENTS

| | | | | | |
|---|---|---|---|---|---|
| 3,945,467 | A | | 3/1976 | Levitz | 186/1 |
| 4,051,615 | A | * | 10/1977 | Gosanko et al. | 40/10 D |
| 4,242,817 | A | * | 1/1981 | Ballard | 40/152.1 |
| 4,329,800 | A | * | 5/1982 | Shuman | 40/606 |
| 4,369,948 | A | * | 1/1983 | Krauss et al. | 248/441 A |
| 4,384,416 | A | * | 5/1983 | Kanzelberger | 40/10 D |
| D283,954 | S | * | 5/1986 | Daws | D6/310 |
| D298,553 | S | * | 11/1988 | Zobitz | D20/43 |
| D333,163 | S | * | 2/1993 | Mendelsohn | D20/40 |
| 5,456,033 | A | * | 10/1995 | Sachnoff | 40/661 |
| 5,499,407 | A | * | 3/1996 | Arwell | 5/1 |
| D370,355 | S | * | 6/1996 | Kenney | D6/314 |
| 5,701,695 | A | * | 12/1997 | Current | 40/606 |
| 5,855,281 | A | | 1/1999 | Rabas | 211/59.3 |
| 5,887,369 | A | | 3/1999 | Danielczak | 40/428 |
| 5,924,367 | A | | 7/1999 | Henke | 108/108 |
| 5,983,545 | A | | 11/1999 | Marco | 40/610 |
| 6,009,651 | A | | 1/2000 | Current | 40/605 |
| 6,029,831 | A | | 2/2000 | Miller | 211/189 |
| D425,566 | S | * | 5/2000 | Mueller et al. | D20/43 |
| 6,070,741 | A | | 6/2000 | Bachman | 211/13.1 |

* cited by examiner

*Primary Examiner*—Paul N. Dickson
*Assistant Examiner*—Benjamin A Pezzlo
(74) *Attorney, Agent, or Firm*—Wendy Buskop

(57) ABSTRACT

A visual display system for slidably engaging between a mattress and a box-spring for use in a retail furniture sales setting comprising a base; a first vertical front surface connected to the base; an angled front surface connected to the first vertical front surface having an angle of incidence from the first vertical front surface of between 10 and 40 degrees; a second vertical front surface connected to the angled front surface having a top edge; a back vertical panel secured to said top edge forming a first slot between second vertical front surface and back vertical panel for holding product information; and an angled back panel connected to said back vertical panel forming a second slot between the angled front surface and the angled back panel for holding product information.

5 Claims, 2 Drawing Sheets

FOUR PANEL VISUAL DISPLAY SYSTEM

BACKGROUND OF THE INVENTION

The present invention relates to a four panel product display system which includes a basic unit with four panels for viewing product information.

Various display systems exist in the market and in the patent literature. U.S. Pat. No. 5,855,281 is directed to a product display system having a track, with projections and hooks. U.S. Pat. No. 6,070,741 is directed to a merchandise display unit that uses two vertical, parallel, spaced wing walls and a vertical back wall attached to a rear end of the wind wall for multi-planar display of various merchandise. U.S. Pat. No. 5,924,367 is directed to a shelf sign system with various pivotable brackets and panels for displaying product information. U.S. Pat. No. 5,983,545 is directed to a lightweight assembly for displaying a poster, which has crossbars, and H shape and legs. Various other panel display systems are taught in U.S. Pat. Nos. 6,029,831, 3,945,467, 5,887,369, and 6,009,651. Most of these systems have components that are expensive to make, such as metal hardware, and elements, which can rip and tear fabric should they become connected to such material.

The present invention is directed at a low cost multipanel signage system which can be used particularly on mattresses. None of the patents noted above teach the unique features of the present invention.

SUMMARY OF THE INVENTION (a) The invention is directed towards a visual display system comprising a base, a first vertical front surface connected to the base, an angled front surface connected to the first vertical front surface having an angle of incidence from the first vertical front surface of between 10 and 40 degrees. second vertical front surface connected to the angled front surface having a top edge, a back vertical panel secured to said top edge forming a first slot between second vertical front surface and back vertical panel for holding product information, and an angled back panel connected to said back vertical panel forming a second slot between the angled front surface and the angled back panel for holding product information.

The invention further includes a vertical display panel molded to the base of clear plastic.

It is an object of the present invention to provide a non-tipping display sign, particularly usable for the retail sales of mattresses.

It is an object of the present invention to provide a light, plastic sign, which can display at least 4 product signs, wherein each product sign is a standard 8½×11-inch sheet of paper.

It is an object of the present invention to provide an inexpensive new retail sign.

An object of the present invention is to provide a collapsible sign for use with the sale of mattresses or other furniture.

Further and more specific objects and advantages of the present invention will become more readily apparent from the following detailed description of a preferred embodiment thereof taken in conjunction with the drawings.

DETAILED DESCRIPTION

Figure 1:
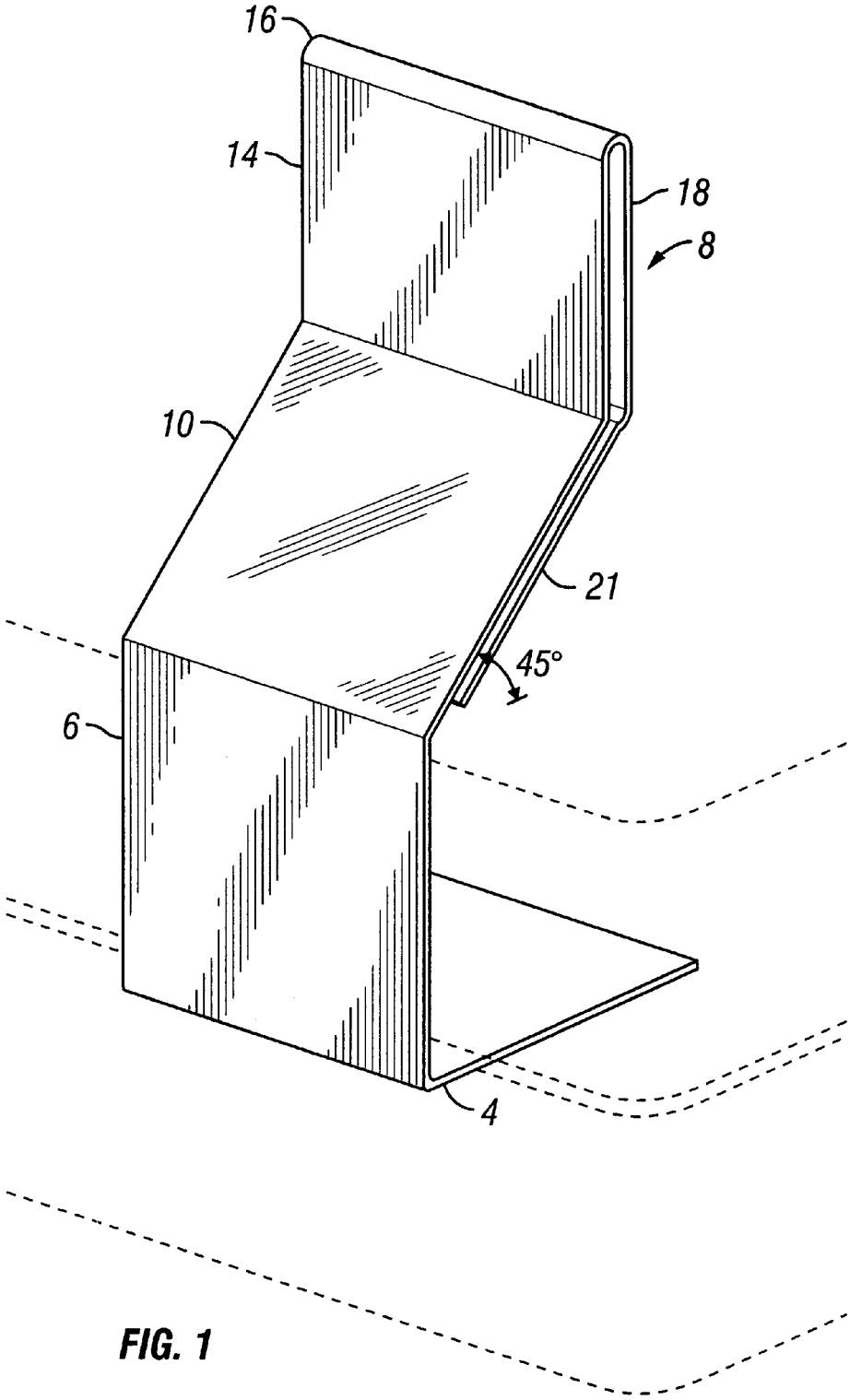
FIG. 1 is a side view of a first embodiment of the invention.

FIG. 1 shows the visual display system 8 of the present invention having a base 4 with a first vertical front surface 6.

The first vertical front surface 6 is connected to an angled front surface 10, which in turn is connected to a second vertical front surface 14 having a top edge 16, a back vertical panel 18 which is connected to an angled back panel 21.

Figure 2:
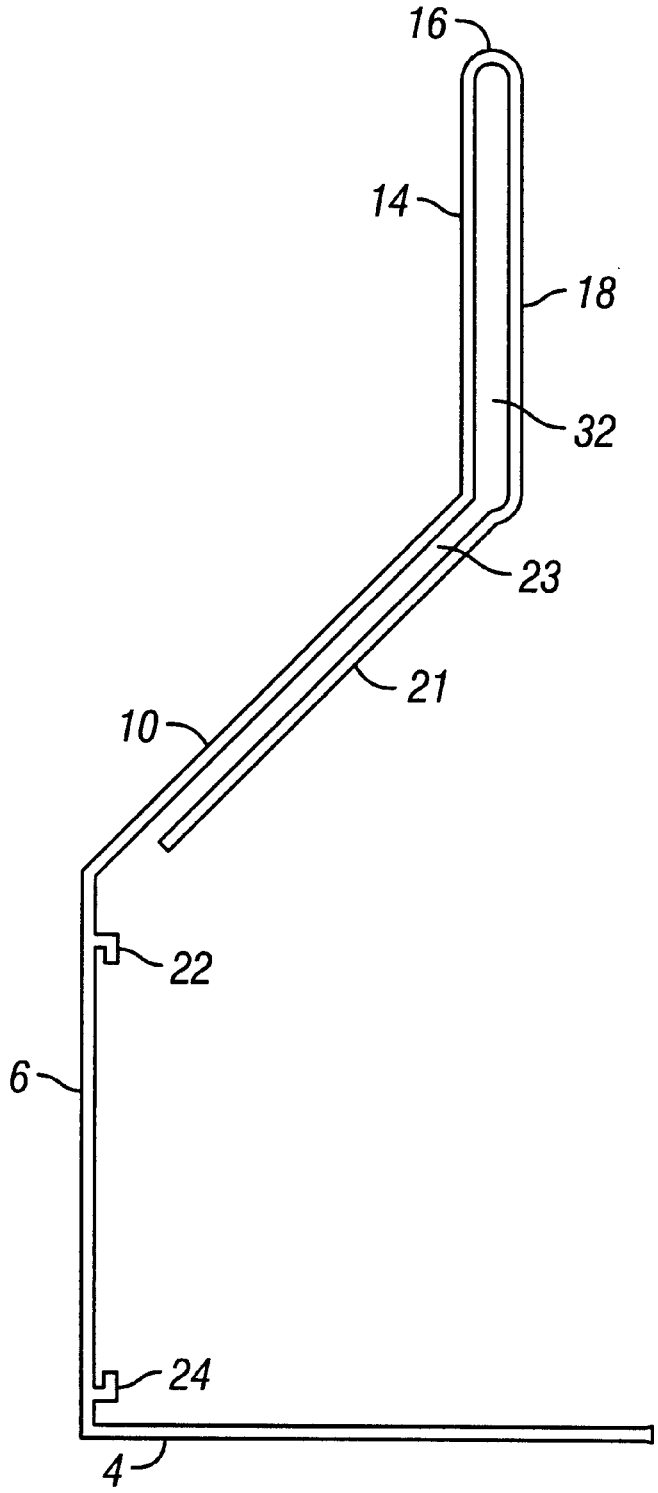
FIG. 2 is a side view of a second embodiment of the invention.

FIG. 2 shows that first bracket 22 and second bracket 24 can be secured to first vertical front surface 6 on the back side to hold further product information enabling the sign to display product information on four panels.

In another embodiment of the invention, brackets 22 and 24 being connected to the first vertical front surface 6 on the back side, can be secured to the front side to hold additional product information including fabric swatches.

In this embodiment, the angled front surface 10 is angled at an angle of incidence relative to the vertical plane of vertical front surface 6 of between 10 and 40 degrees. The angle of back panel 21 can parallel the angle of incidence of angled front surface 10 forming a first slot 23 for holding product literature.

Back vertical panel 18 connects to top 16 and parallels second vertical front surface 14 forming a second slot 32 between back vertical panel 18 and second vertical front surface 14.

Into these slots 23, and 32, product information can be inserted enabling display of product information through back vertical panel 18, through angled front surface 10 and second vertical front surface 14 without the need for any additional hooks, adhesives or any other material whatsoever.

It is prefer red that this product display mechanism is made from one-piece clear plastic which can be hot molded or poured into the correct shape.

It is considered that this invention could be modified so that top edge 16 and the edge at which base 4 meets first vertical front surface 6 could be hinged or latching connections and not an entire one-piece construction.

Various devices can be used to hold articles onto the display panels. For example, a product brochure tray, or a tray for holding fabric samples of mattress coverings, or forms for customers to complete can be secured to the front surface of the vertical display panel. Clips rather than brackets 22 and 24 can be used to hold these materials to the panels and yet remain within the scope of the invention.

In the most preferred embodiment, the entire visual display system is preferably made of clear polyethylene/polypropylene material.

Vertical display panel of the present invention can be etched or painted to add more display information to the display system.

In the most preferred embodiment, the angled front surface 10 is angled between 4 and 45 degrees off of a vertical plane of the vertical display panel, and more preferably 15 degrees of f of the vertical plane created by the vertical display panel.

It is preferred that the invention can be constructed such that the first vertical front surface 6, the angled front surface 10, the second vertical front surface 14, the back vertical panel 18, and the angled back panel 21 each have a width of between 5 inches and 20 inches, and a height of between 5 inches and 30 inches. However, it is contemplated that the surfaces and panels may have different widths from each other and different heights and remain within the scope of the present invention.

In the most preferred embodiment, the invention is constructed wherein the first vertical front surface 6, the angled front surface 10 and the second vertical front surface 14 are identical in width and height. It is also the most preferred embodiment that that width of each of those surfaces be 9 inches and capable of accommodating 8½×11" paper. It is also preferred to create a visual sign system, which uses plastic sheets as the material for the unit, wherein each sheet has a thickness of between 0.15 and 0.5 inches.

In yet another preferred embodiment it is preferred that angled front surface 10 and the second vertical front surface each be 12 inches high.

In the preferred embodiment, it is preferred that the base 4 be 12 inches long, although a longer base could be used. The base is to be of a proper thickness to slide between a mattress and box spring. It is also preferred that the base 4 have the same width as the panels.

In the preferred embodiment, it is contemplated that the vertical display panel has an overall height of at least 24 inches. The most preferred embodiment is between 24 and 48 inches in height. A preferred version of the sign is 36 inches in height.

The invention is contemplated as particularly usable on mattresses and box springs for sail in retail showrooms.

It is contemplated that an illumination means could be used secured to the tope edge 16 for illuminating the sign. The illumination means could be halogen or bulbs, battery or 110 volt.

Those skilled in the art will now see that certain modifications can be made to the apparatus and the methods herein disclosed with respect to the illustrated embodiments, without departing from the sprit of the instant invention. While the invention has been described above with respect to the preferred embodiments, it will be understood that the invention id adapted to numerous rearrangements, modifications and alterations and all of such arrangements, modifications and alterations are intended to be within the scope of the appended claims.

What is claimed is:

1. A visual display system comprising:

(b) a base;

(c) a first vertical front surface connected to said base;

(d) an angled front surface connected to said first vertical front surface having an angle of incidence from the first vertical front surface of between 10 and 40 degrees;

(e) a second vertical front surface connected to said angled front surface having a top edge;

(f) a back vertical panel secured to said top edge forming a first slot between second vertical front surface and back vertical panel for holding product information, (g) an angled back panel connected to said back vertical panel forming a second slot between the angled front surface and the angled back panel for holding product information.

2. The visual display system of claim 1, wherein said angled front surface is angled between 10 and 20 degrees off of the vertical plane of said first vertical front surface.

3. The visual display system of claim 1, wherein said angled front surface and said second vertical front surface and said first vertical front surface each has a width of between 5 inches and 20 inches, and a height of between 5 inches and 30 inches.

4. The visual display system of claim 3, wherein said surfaces are each 9 inches wide and 12 inches high.

5. The visual display system of claim 1, wherein said angled front surface has at least one retainer clip locking to the periphery of said surface for holding product information.

* * * * *